US007043436B1

(12) United States Patent
Ryu

(10) Patent No.: US 7,043,436 B1
(45) **Date of Patent: *May 9, 2006**

(54) APPARATUS FOR SYNTHESIZING SPEECH SOUNDS OF A SHORT MESSAGE IN A HANDS FREE KIT FOR A MOBILE PHONE

(75) Inventor: Byung-Seok Ryu, Anyang-shi (KR)

(73) Assignee: Samsung Electronics Co., Ltd., (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/263,440

(22) Filed: Mar. 5, 1999

(30) Foreign Application Priority Data

Mar. 5, 1998 (KR) ..... 1998-7287

(51) Int. Cl.
*G10L 21/06* (2006.01)

(52) U.S. Cl. ..... 704/270.1; 704/258

(58) Field of Classification Search ..... 704/270, 704/275, 232, 231, 234; 455/557, 563, 406, 455/566, 569; 379/354, 93.06; 340/825.44, 340/557, 563, 406, 506; 709/245
See application file for complete search history.

(56) References Cited

U.S. PATENT DOCUMENTS 4,870,686 A * 9/1989 Gerson et al. ..... 704/234
4,959,850 A * 9/1990 Marui ..... 379/354
5,175,759 A * 12/1992 Metroka et al. ..... 455/569
5,594,658 A * 1/1997 Lemaire et al. ..... 709/245
5,613,038 A * 3/1997 Lemaire et al. ..... 704/270
5,699,053 A * 12/1997 Jonsson ..... 340/7.21
5,799,067 A * 8/1998 Kikinis et al. ..... 379/93.06
5,799,068 A * 8/1998 Kikinis et al. ..... 379/93.06
5,950,123 A * 9/1999 Schwelb et al. ..... 455/414
5,991,640 A * 11/1999 Lilja et al. ..... 455/557
6,052,070 A * 4/2000 Kivelä et al. ..... 341/22
6,087,956 A * 7/2000 Helferich ..... 340/825.44
6,125,284 A * 9/2000 Moore et al. ..... 455/563
6,167,251 A * 12/2000 Segal et al. ..... 455/406
6,178,398 B1 * 1/2001 Peterson et al. ..... 704/232
6,181,956 B1 * 1/2001 Koskan ..... 455/506

FOREIGN PATENT DOCUMENTS

CH 1148782 4/1997
GB 2 303 953 3/1997

OTHER PUBLICATIONS

Klatt, "Review of Text-to-Speech Conversion for English", J. Acoust, Society of America, 82 (3), pp. 737-793, Sep. 1987.*

* cited by examiner

*Primary Examiner*—David D. Knepper
(74) *Attorney, Agent, or Firm*—Dilworth & Barrese LLP

(57) ABSTRACT

Synthesizing speech sounds to express a short message received from a caller in a handset coupled to a hands free kit, includes handset circuitry for transferring an alarm signal to the hands free kit to generate an alarm to inform the user of the receipt of the short message, and for transferring the short message to the hands free kit when receiving a short message calling signal from the hands free kit. The short message calling signal is generated upon the detection of a predetermined voice command by the user indicating a desire to hear the short message. The hands free kit includes circuitry for synthesizing the speech sounds according to the short message received from the handset.

9 Claims, 4 Drawing Sheets

APPARATUS FOR SYNTHESIZING SPEECH SOUNDS OF A SHORT MESSAGE IN A HANDS FREE KIT FOR A MOBILE PHONE

BACKGROUND OF THE INVENTION

1. Field of the Invention

The present invention relates to a hands free kit for a car phone or mobile phone used in a car, and more particularly, to an apparatus for generating speech sounds of a short message received by the mobile phone by means of a digital signal processor (DSP).

2. Description of the Related Art

A hands free kit for a car phone or portable mobile phone used in a car enables the driver to safely communicate through the mobile phone without holding the phone, e.g., while both hands are on the steering wheel. (As used hereafter, the term "mobile phone" applies to both a dedicated car phone and a portable mobile phone.) The hands free kit employs a half-duplex circuit to transmit/receive audio signals to/from the handset of the mobile phone through transmit and receive lines, respectively. The half-duplex circuit functions to prevent sounds from the speaker from being inputted to the microphone, i.e., to prevent feedback.

A conventional hands free kit performs the communication function only when the driver has established the communication path between the handset and the hands free kit by manually operating a key on the handset. In order to eliminate such manual handset operation, the hands free kit has recently been provided with a voice control means to control the functions of the handset and to dial by voice. This feature is made possible by equipping the hands free kit with speech recognition technology embodied by a DSP therein.

Mobile phone handsets have been furnished with short message service (SMS) from communication service providers. The SMS is used to transmit a short message to the mobile phone from a caller or broadcasting service, which is displayed on the mobile phone handset display in characters. When receiving a short message, the handset outputs an audible alarm to alert the user of the reception of a message. If a short message is received while the system is operating in the hands free mode, i.e., with the handset connected to the hands free kit, the handset delivers a signal to the hands free kit indicating the same, whereupon the hands free kit sounds an alarm. The user must then manually operate the handset to read the message on the handset display. Should the user attempt to perform this task while actively driving, however, the user may create a hazardous situation.

SUMMARY OF THE INVENTION

It is an object of the present invention to provide an apparatus for synthesizing speech sounds to express a short message received in a handset coupled to a hands free kit by means of speech recognition and speech synthesis, and a method therefor.

According to one aspect of the invention, an apparatus for synthesizing speech sounds to express a short message received from a caller in a handset coupled to a hands free kit, includes handset circuitry for transferring an alarm signal to the hands free kit to generate an alarm to inform the user of the receipt of the short message. The handset transfers the short message to the hands free kit when receiving a short message calling signal from the hands free kit. The short message calling signal is generated upon the detection of a predetermined voice command by the user indicating a desire to hear the short message. The hands free kit includes circuitry for synthesizing speech sounds corresponding to the short message received from the handset.

According to another aspect of the present invention, a method for synthesizing speech sounds to express a short message in a hands free kit includes: generating an alarm upon receiving an alarm signal from the handset to inform the user of the receipt of a short message; detecting whether speech is input; detecting whether a sound data storage contains the same sound characteristics as the input speech; detecting whether the input speech is a sound synthesis command; and transmitting a short message calling signal to the handset upon detecting the sound synthesis command. The short message is then received from the handset and analyzed to synthesize the sound data corresponding to the short message by reading sound element data from a sound element code storage according to the analyzed result. The sound data is then converted into analog audio signals applied to a speaker.

The present invention will now be described more specifically with reference to the attached drawings only by of example.

DETAILED DESCRIPTION OF THE PREFERRED EMBODIMENT

Figure 1:
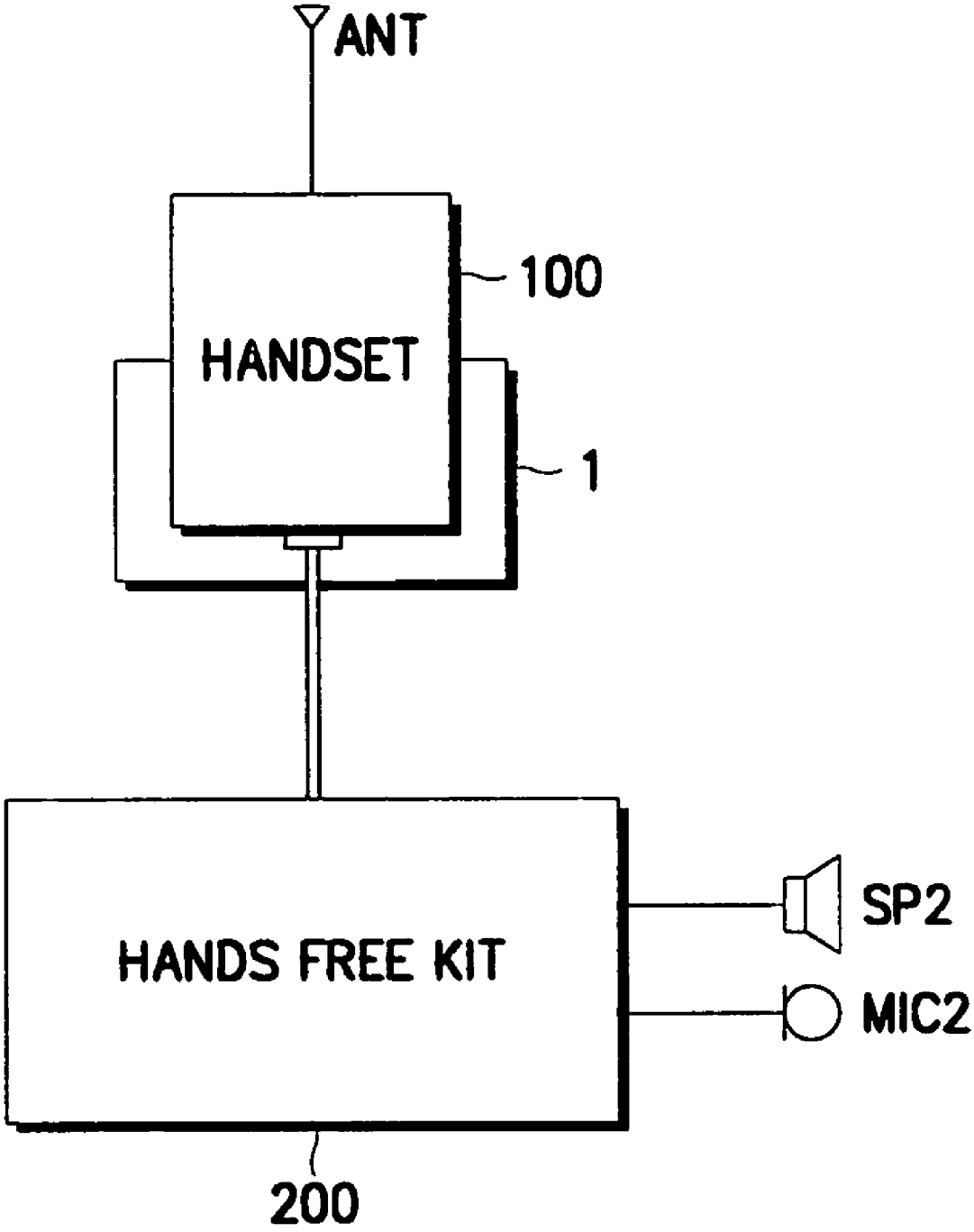
FIG. 1 is a schematic diagram of a handset connected to a hands free kit.

Referring to FIG. 1, a connection arrangement of a hands free kit 200, a mobile phone handset 100 and a cradle 1 is depicted. Handset 100 is mountable on cradle 1, with the former having a hands free connector connected to hands free kit 200 through a hands free cable. The cradle 1 also typically contains electronics and a hands free kit connector. A hands free mode may be entered automatically when the handset is mounted on the cradle, or by depressing a specific key (not shown) on the handset or on the hands free kit. In the hands free mode, when a communication channel is established by receiving or transmitting a call through the handset 100, the user's speech is captured by a hands free kit microphone MIC 2 and the incoming audio wirelessly received from the other calling party is output by hands free kit speaker SP2. Hands free kit 200 transfers the audio signals received from the handset through the hands free cable to speaker SP2, or routes the audio signals generated by microphone MIC2 to the handset 100 to wirelessly transmit the same to the other calling party through an antenna ANT. The cradle 1 is also connected to the hands free kit 200 and provides signals to the hands free kit to inform the same of the state of the handset 100 mounted on the cradle 1 or the battery power level thereof. Note that antenna ANT may either be mounted on the handset itself or on the automobile; in the latter case the antenna is connected to the handset via a wire.

Figure 2:
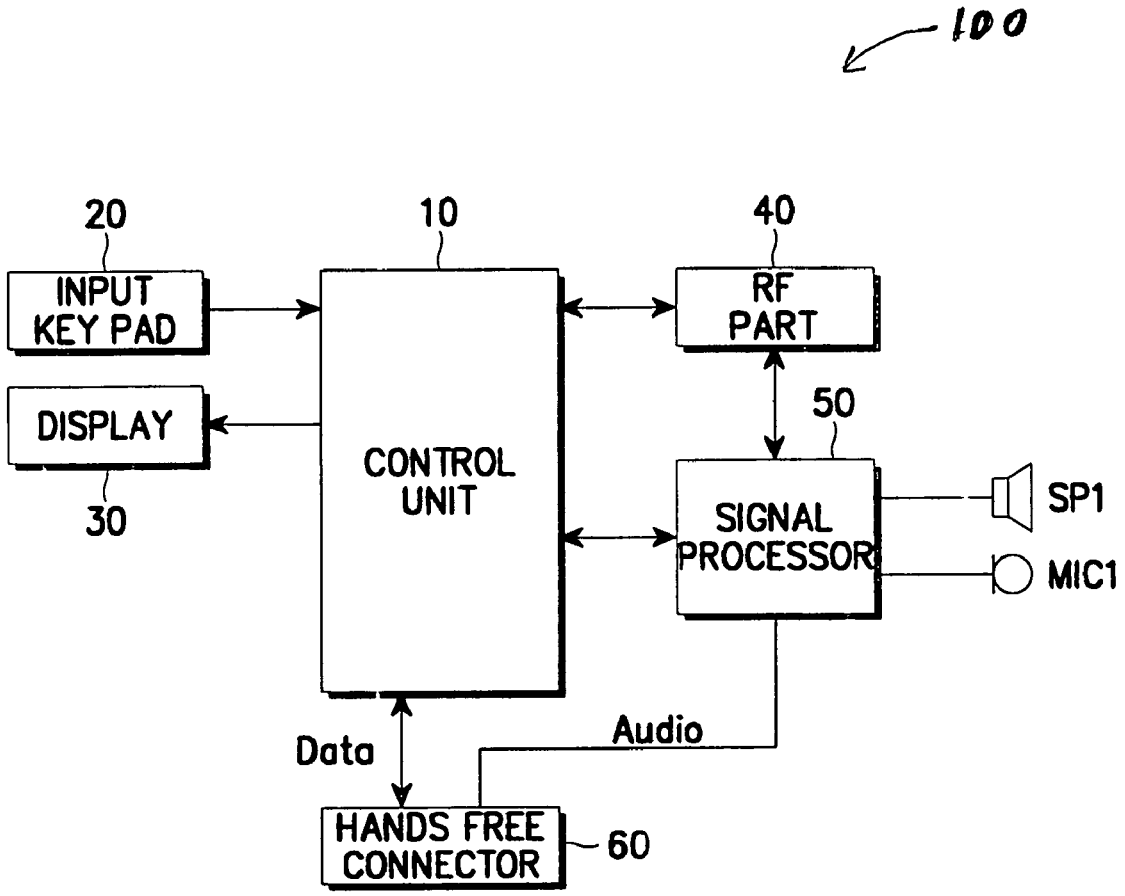
FIG. 2 is a block diagram of a mobile phone handset.

Referring to FIG. 2, a block diagram illustrating an exemplary configuration of handset 100 is shown. A first control unit 10 includes a read only memory (ROM) for storing an operational program, a random access memory (RAM) for temporarily storing data generated when executing the operational program, and a read/write memory such as an electronically erasable and programmable read only memory (EEPROM). An input key pad 20 includes a plurality of alphanumeric and functional keys to generate key data transferred to the first control unit 10. Control unit 10 controls a display 30 to display the key data and various information such as the operational state of the handset in icons and characters. A radio frequency (RF) part 40 modulates and demodulates the signals received and transmitted through the antenna. A signal processor 50 processes the audio or data signals received from the RF part 40 to generate sound through a speaker SP1 or data transferred to the first control unit 10. The signal processor 50 encodes the audio signals received through the microphone MIC1, converting them into the baseband signals transferred to the RF part 40. It also converts the data received from the first control unit 10 into the baseband signals transferred to the RF part 40. The hands free connector 60 is connected through a data line to the first control unit 10, and through an audio line to the signal processor 50.

With handset 100 mounted on the cradle 1 and connected through the hands free connector 60 to the hands free kit 200, the handset 100 and hands free kit 200 are initialized according to a prescribed protocol. Then, control unit 10 controls the signal processor 50 to transfer the audio signals received from the RF part 40 to the hands free kit 200. Control unit 10 also controls the signal processor 50 to transfer the audio signals generated by the microphone MIC2 of the hands free kit 200 to the RF part 40. Generally, the hands free connector 60 of handset 100 includes a data transfer terminal and a battery recharging terminal.

Figure 3:
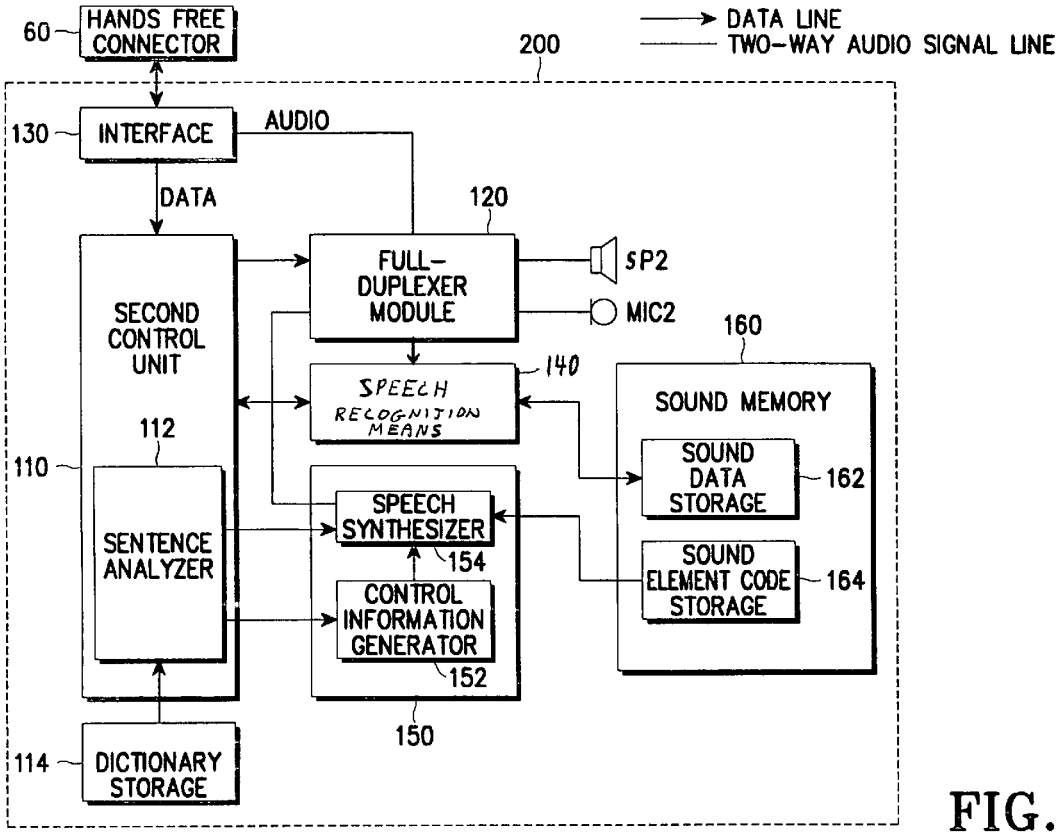
FIG. 3 is a block diagram of a hands free kit that synthesizes speech sounds according to an embodiment of the present invention.

With reference now to FIG. 3, a block diagram of an exemplary configuration of hands free kit 200 is shown. An interface 130, connected to handset 100 via hands free connector(s) 60 and a hands free cable (if any), separates the signals received from handset 100 into data and audio signals. A second control unit 110 includes ROM for storing an operational program, RAM for temporarily storing the data generated when executing the operational program, and an EEPROM for storing telephone numbers inputted by the user. The second control unit 110 may consist of a one-chip microprocessor including a sentence analyzer 112 to analyze the SMS short message received from the handset 100 through the interface 130.

A dictionary storage 114 stores a body of information concerning the alphabet for the associated language including phonetic information. Storage 114 is preferably included in the EEPROM of control unit 110, but is shown separately for clarity of presentation. The sentence analyzer 112 analyzes the short message into phonetic symbols and sound elements in reference to the dictionary storage 114 so as to generate grammatical information data of the phonetic symbols and the phonetic information data of the sound elements.

A full-duplexer module 120 performs simultaneous transmission in both directions under the control of the second control unit 110 to transfer the audio signals from the handset 100 to the speaker SP2, and those from microphone MIC2 through the interface 130 to the handset 100. Module 120 includes an echo canceler (not shown) to eliminate reflective noises. A sound memory 160 includes a sound data storage 162 and a sound element code storage 164. The sound data storage 162 stores speech sound data to dial by voice in a voice dialing mode, as well as addresses in the EEPROM of stored phone numbers corresponding to the stored speech sound data. Data storage 162 also stores speech sound data corresponding to voice commands to control the functions and the addresses of the functional flags, which are stored in a specific memory of the handset 100 to set its functions. The sound code element storage 164 stores the sound element codes to represent respective alphabet letters, sub-words and words, e.g., of the Korean language.

The sound data stored within sound data storage 162 may be obtained during a set-up mode (or training mode) of the system. In particular, during the set-up mode, the user is prompted to speak one or more specific commands. One command, e.g., "read message", is an instruction for the system to proceed with a speech synthesis operation when a short message is received. The short message is then converted to synthesized or "canned" speech and output through the speaker SP2. As will be explained further below, in the hands free operating mode, when handset 100 receives a short message through the wireless communication system, an alarm is generated to inform the user of the same. Then, if the user utters the appropriate "read message" command, and the system properly recognizes the command, the system will convert the short message to audible speech. To improve the probability of successful speech recognition, during the set-up mode, the user utters the "read message" and other commands for conversion into audio feature data by a speech recognition means 140. This audio feature data is stored in sound data storage 162 as feature data to be subsequently compared against during system operation. Additionally, the training mode is used to collect and store called party name data to be compared against in the voice dialing mode. The voice dialing mode and the short message synthesis mode are preferably concurrent modes. That is, during hands free operation, the user is able to both dial by voice and to listen to synthesized short messages.

During the hands free operating mode, speech recognition means 140 converts analog audio signals from the microphone MIC2 to sound data, which is compared with the sound data stored in sound data storage 162. When a short message is received and an alarm is generated indicating the same, the speech recognition system compares received speech with the stored command for initiating speech synthesis with respect to the message. In the voice dialing mode, the input speech is compared to the stored called party name data. In either case, when a match between input speech and stored sound data is found, speech recognition means 140 informs the second control unit 110 of the address representing the sound data of the stored speech.

The speech synthesis module 150 processes grammatical information data of phonetic symbols and phonetic information data from the sentence analyzer 112, corresponding to the SMS message, to generate sound data for conversion to analog audio signals. This results in the received SMS message being converted to audible speech which is output by speaker SP2. Module 150 includes a control information generator 152 and a speech synthesizer 154. The control information generator 152 arranges synthetic units of the speech according to the grammatical information data of the phonetic symbols to generate the control information concerning the phonemes, pitches, strengths, lengths, tempos, rhythms, etc. of the speech sounds. The speech synthesizer 154 retrieves the sound element data from the sound element code storage 164 according to the phonetic information data to synthesize the sound data. It converts the sound data to the desired audio signals according to the control information data. The audio signals are transferred through the full-duplexer module 120 to the speaker SP2. The speech recognition means 140 and sound synthesis module 150 are each preferably embodied as part of a DSP.

Figure 4:
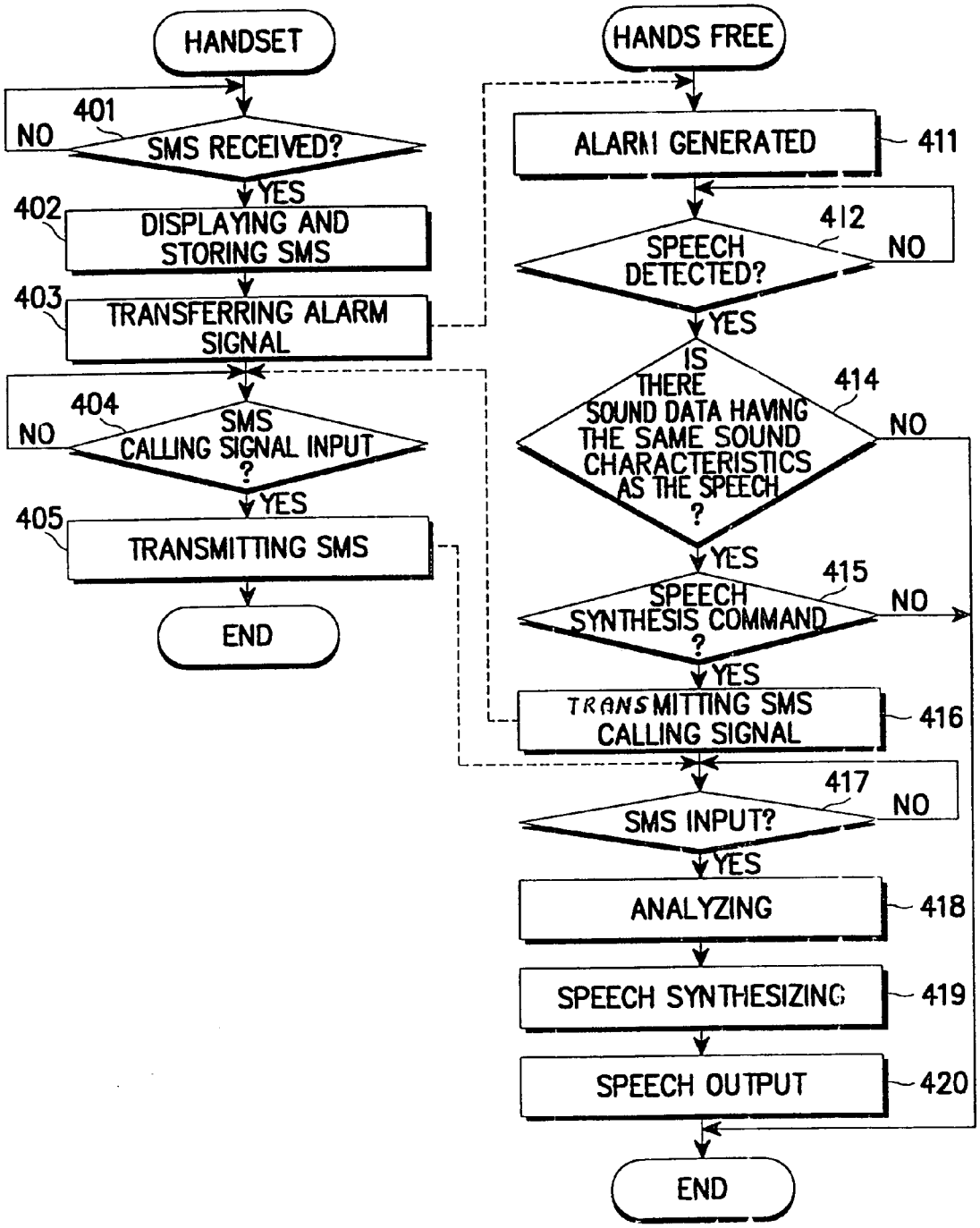
FIG. 4 is a flow chart illustrating a method of synthesizing speech sounds to express a short message in accordance with the invention.

FIG. 4 is a flowchart illustrating a method of synthesizing speech sounds of a short message in accordance with the invention. The method steps on the left hand side, 401–405, represent steps performed in the first control unit 10 of handset 100, whereas those on the right hand side, 411 to 420, are performed in the second control unit 110 of the hands free unit. The first control unit 10 of handset 100 detects receipt of a short message in step 401. The received short message is displayed on the display 30 and stored in memory in step 402. Then, first control unit 10 informs the hands free kit 200 of the receipt of the short message by transferring an alarm signal through the hands free connector 60 in step 403.

When the alarm signal is transferred through the interface 130 of the hands free kit 200 to the full-duplex module 120 in step 403, the second control unit 110 controls the full-duplex module 120 to generate an alarm through the speaker SP2 in step 411. At this point, the system is striving to detect the previously stored, special speech command of the user, e.g., "read message". Upon proper detection of this command, the system proceeds to convert the short message to audible speech. Simultaneously, the system is also listening for a called party name, or a previously stored telephone number, to be dialed in the voice dialing mode. If speech corresponding to a stored called party name or telephone number is recognized by means of a favorable comparison of the input speech with previously stored data in sound data storage 162, the system will first convert the corresponding stored data to an audible output to allow the user to verify the same via another voice command, prior to the system automatically dialing the telephone number.

Thus, to implement the above functions, if the second control unit 110 detects speech from microphone MIC2 in step 412, the speech recognition means 140 receives input speech from the full-duplexer module 120 to generate corresponding sound data under the control of the second control unit 110 in step 414. Then, the speech recognition means 140 compares the sound data of the input speech to ascertain whether the sound data storage 162 contains the corresponding sound data having the same (or substantially the same) sound characteristics as the speech in step 414. If so, the speech recognition means 140 retrieves the address representing the sound data to transfer it to the second control unit 110. In step 415, the second control unit 110 determines whether the data stored in the address represents a telephone number or functional command. If the data is a functional command, the second control unit 110 determines whether the functional command indicates a speech synthesis command. If it is the speech synthesis command, the second control unit 110 generates a short message calling signal transmitted through the interface 130 to the handset 100 in step 416.

Meanwhile, the first control unit 10 of the handset 100 detects receipt of the short message calling signal in step 404 after transferring the alarm signal in the previous step 403. Receiving the short message calling signal, the first control unit 10 retrieves the short message from the memory to transfer it through the hands free connector 60 to the hands free kit 200 in step 405. (It is noted here that as an alternative embodiment, the short message can be automatically transferred to the hands free kit as soon as it is received by the handset. In this case, the method steps involving generating and detecting a short message calling signal would be eliminated.)

Subsequently, the second control unit 110 of the hands free kit 200 detects receipt of the short message from the handset 100 in step 417. Receiving the short message, the second control unit 110 analyzes the sentences of the short message in reference to the dictionary of the dictionary storage 114 so as to generate the grammatical information data of the phonetic symbols and the phonetic information data of the sentences to the speech synthesis module 150. The control information generator 152 of the speech synthesis module 150 arranges synthetic units of the speech according to the grammatical information data of the phonetic symbols to generate the control information concerning the phonemes, pitches, strengths, lengths, tempos, rhythms, etc. of the speech sounds. The speech synthesizer 154 of the speech synthesis module 150 retrieves in step 419 the sound element data from the sound element code storage 164 according to the phonetic information data to synthesize the sound data. It also converts the sound data to the desired audio signals according to the control information data. In step 420, the audio signals are transferred through the full-duplexer module 120 to the speaker SP2.

While the present invention has been described with specific embodiments accompanied by the attached drawings, it will be appreciated by those skilled in the art that various changes and modifications may be made thereto without departing the gist of the present invention.

What is claimed is:

1. An apparatus for synthesizing speech sounds to express a short message received in a wireless communications system in a handset coupled to a hands free kit, comprising:

handset circuitry for transferring an alarm signal to said hands free kit to generate an alarm to inform a user of the receipt of said short message, and for transferring said short message to said hands free kit when receiving a short message calling signal from said hands free kit; and hands free kit circuitry for transmitting said short message calling signal to said handset and for synthesizing said short message received from said handset into said speech sounds;

wherein said short message calling signal is generated upon input by the user of a predetermined voice command, and the short message is a character message received from a base station servicing the handset.

2. The apparatus as defined in claim 1, wherein said hands free kit circuitry comprises:

a sound element code storage for storing sound element codes representing respective alphabet letters;

a dictionary storage for storing a dictionary;

a sentence analyzer for analyzing said short message into phonetic symbols and sound elements in reference to said dictionary so as to generate the grammatical information data of said phonetic symbols and the phonetic information data of said sound elements;

a control information generator for generating control information according to said grammatical information data;

a speech synthesizer for synthesizing sound data by reading sound element data from said sound element code storage according to said phonetic information data to convert said sound data into audio signals according to said control information;

a full-duplexer module for transferring said audio signals to a speaker to produce sounds; and a control unit for controlling said sentence analyzer to transmit said short message calling signal to said handset according to an external speech synthesis command upon receiving said alarm signal from said handset.

3. The apparatus as defined in claim 2, wherein said speech synthesizer and control information generator consist of a digital signal processor (DSP).

4. The apparatus as defined in claim 2, wherein said full-duplexer module includes an echo canceler for eliminating reflective noises.

5. In a hands free kit coupled to a handset, said hands free kit comprising a sound data storage for storing sound data to control functions by voice, and a sound element code storage for storing sound element codes representing respective alphabet letters, a method for synthesizing speech sounds to express a short message, comprising the steps of:

generating an alarm upon receiving an alarm signal from said handset to inform the user of the receipt of a short message and detecting whether speech is input;

detecting whether said sound data storage contains sound data having substantially the same sound characteristics as said input speech;

detecting whether said input speech is a sound synthesis command if said sound storage contains sounds having the same sound characteristics as said speech, said sound synthesis command being a voice command input by a user instructing said hands free kit to process said short message as an audio output;

transmitting a short message calling signal generated upon input by said user's voice command to said handset upon detecting said sound synthesis command, the short message is a character message received from a base station servicing the handset;

detecting said short message received from said handset;

analyzing said short message and synthesizing said short message into sound data by reading sound element data from said sound element code storage according to the analyzed result; and converting said synthesized sound data into analog audio signals applied to a speaker.

6. The method as defined in claim 5, wherein said generating an alarm step includes the sub-steps of:

detecting whether said short message is received by said handset;

storing said short message in a memory and displaying it on a display of said handset; and causing said handset to generate said alarm signal transferred to said hands free kit.

7. The method as defined in claim 5, wherein said transmitting step includes the sub-steps of:

causing said handset to detect whether said short message calling signal is received from said hands free kit; and transmitting said short message transferred to said hands free kit upon detecting said short message calling signal.

8. An apparatus for synthesizing speech sounds to express a short message received in a wireless communications system in a handset coupled to a hands free kit, comprising:

handset circuitry operative to transfer said short message to said hands free kit upon input by a user of a predetermined voice command; and hands free kit circuitry adapted to transmit said short message calling signal to said handset and to synthesize said short message received from said handset into said speech sounds;

wherein said handset circuitry is further operative to transfer an alarm signal to said hands free kit upon the receipt of said short message, and said hands free kit circuitry is further adapted to store a voice command indicating a desire for a user to hear a short message, to generate an alarm upon the receipt of said alarm signal, to receive input speech following said alarm generation and determine whether the input speech contains said voice command, and to synthesize said speech sounds and produce said message as an audible output upon the detection of said voice command, and the short message is a character message received from a base station servicing the handset.

9. The apparatus as defined in claim 8, wherein said hands free kit circuitry is further adapted to store a plurality of voice dialing mode data, and to determine, after said alarm generation, whether said input speech corresponds to any of said voice dialing mode data and if so to synthesize sounds of the corresponding voice dialing mode data without synthesizing sounds of said short message.

* * * * *